US005568772A

United States Patent [19]

Carson

[11] Patent Number: 5,568,772

[45] Date of Patent: Oct. 29, 1996

[54] SHOWER DOOR SHELF

[76] Inventor: Bradley C. Carson, 1412 Country Rd., Troy, Mich. 48098

[21] Appl. No.: 447,535

[22] Filed: May 24, 1995

[51] Int. Cl.[6] ..... A47B 37/00

[52] U.S. Cl. ..... 108/42; 211/90

[58] Field of Search ..... 108/42, 50; 211/90, 211/88; 248/214

[56] References Cited

U.S. PATENT DOCUMENTS

| | | | |
|---|---|---|---|
| D. 251,999 | 1/1979 | Bautista . | |
| D. 335,232 | 5/1993 | Whitlock . | |
| 3,373,448 | 3/1968 | Butler . | |
| 3,598,463 | 8/1971 | Kesling | 312/405.1 |
| 4,074,635 | 2/1978 | Stauble | 211/90 |
| 4,191,110 | 3/1980 | Klukos . | |
| 4,233,911 | 11/1980 | Vignale . | |
| 4,398,309 | 8/1983 | Simmons . | |
| 4,553,275 | 11/1985 | Goldstein . | |
| 4,799,432 | 1/1989 | Rickner | 108/42 |
| 4,827,849 | 5/1989 | Vignale . | |
| 5,433,152 | 7/1995 | Henry | 108/42 |

*Primary Examiner*—Peter M. Cuomo
*Assistant Examiner*—Gerald A. Anderson

[57] ABSTRACT

This invention relates to a shelf mounting between a shower door and a bar mounted across the door. The shelf is a molded, thin wall, integral body and comprises a compartment atop left and right, trapezoidal shaped, hollow legs respectively contiguous with the compartment. The compartment has (a) a tray with an upper surface unobstructed between left and right edges thereof, (b) a front extending above the tray along its front edge and (c) left and right sides, the left and right sides respectively being integral with left and right ends of the front and spaced from the left and right edges of the tray. The left and right, trapezoidal shaped, hollow legs respectively have (a) left and right trapezoidal shaped inner legs. These inner legs respectively have shapes with their smallest sides spaced a distance beneath an underside of the tray, second smallest sides contiguous with this underside from the rear edge of the tray to a location of the underside rearward the front edge, third sides substantially perpendicular to the rear edge of the tray and fourth sides extending from the smallest sides to the sides contiguous with the tray. The left and right, hollow, trapezoidal shaped legs also have (b) left and right trapezoidal shaped outer legs respectively (i) contiguous beneath the left and right sides, (ii) having configurations substantially matching, and (iii) spaced outside, the left and right trapezoidal shaped inner legs and (c) left and right leg fronts respectively extending between the left inner and outer trapezoidal shaped legs and right inner and outer trapezoidal shaped legs.

17 Claims, 2 Drawing Sheets

SHOWER DOOR SHELF

This invention relates to shelving that may be exposed intermittently to water and vibration and to a novel configuration for such shelves. This invention, more particularly, relates to a shelf mounting to a shower door between the handle or bar carried on the door and the door.

Shower doors having bars or handles mounted to them are available widely. One practice utilizes the handles or bars to brace against the door shampoo bottles and other items of personal care used during bathing. Experience with this practice, however, proves it unsatisfactory, particularly in the case of sliding or latching shower doors or doors adjacent thereto.

Shelves or other such appliances used in holding things for use in showers and baths are known. See, for example, U.S. Pat. Nos. 3,373,448; 4,191,110; 4,233,911; 4,398,309; 4,553,275 and 4,827,849. See, also, design patents U.S. Pat. No. Des. 251,999; U.S. Pat. No. Des. 335,232. While patents of this list show shelves and appliances useful in storing items even in wet environments such as showers, none show molded shelves that drain through hollow legs mountable between a bar or the like carried on shower doors and the door. It is noted that U.S. '849 does show shelving having wedge shaped legs. U.S. '849, however, proposed for dry, stable environments, shows neither a pair of double edge legs nor tray with unobstructed surface that is readily washable.

It is a principle object of this invention to provide a shelf adapted for use in conveniently storing items of personal care, such as shampoo bottles and the like, to be used in connection with bathing;

It is an additional object of this invention to provide such a shelf that is mountable between shower door and bar mounted across the door;

It is an additional object of this invention to provide a design for such a shelf that is a molded body with a configuration allowing it to be stackable and readily washable along its tray having unobstructed surface.

These and other objects are accomplished as will be apparent from the hereinafter disclosure.

BRIEF DESCRIPTION OF THE INVENTION

This invention relates to a shelf mounting between a shower door and bar or handle mounted on the door, the shelf being in the form of a molded body. The molded body comprises a compartment atop left and right hollow legs, preferably, respectively having a wedge shape. The compartment has (a) a tray (b) a front extending above the tray along a front edge thereof and (c) left and right sides respectively integral left and right ends of the front and spaced from left and right edges of the tray. The hollow legs respectively have inner and outer sides. The outer sides respectively depend from the left and right sides. The inner sides respectively depend from the tray beneath left and right edges thereof.

The legs are used in the mounting of the shelf between a bar or handle carried on a shower door and the door. In preferred embodiments, trapezoidal configuration of the legs permits them to be wedged between the handle or bar and glass or like material carried in the shower door. Holes in the bottoms of the legs permit drainage from the shelf out of the legs.

BRIEF DESCRIPTION OF THE DRAWINGS

FIG. 1 is a partly developed, front plan view of the shelf.

FIGS. 2 and 3 are, respectively, top and bottom plan views of the shelf.

FIGS. 4 and 5 are, respectively, left side and back plan views of the shelf.

DETAILED DESCRIPTION OF PREFERRED EMBODIMENT

Shelf 10 in FIGS. 1–5 is a light weight, plastic body; its walls are thin, e.g., have thicknesses ranging between about one sixteenth (1/16th) and one thirty-second (1/32th) of an inch (0.156 cm. and 0.078 cm.). Length, width and height of the shelf are about 14, 3 and 7 inches (35, 7.5 and 17.5 cm), respectively.

Figure 1:
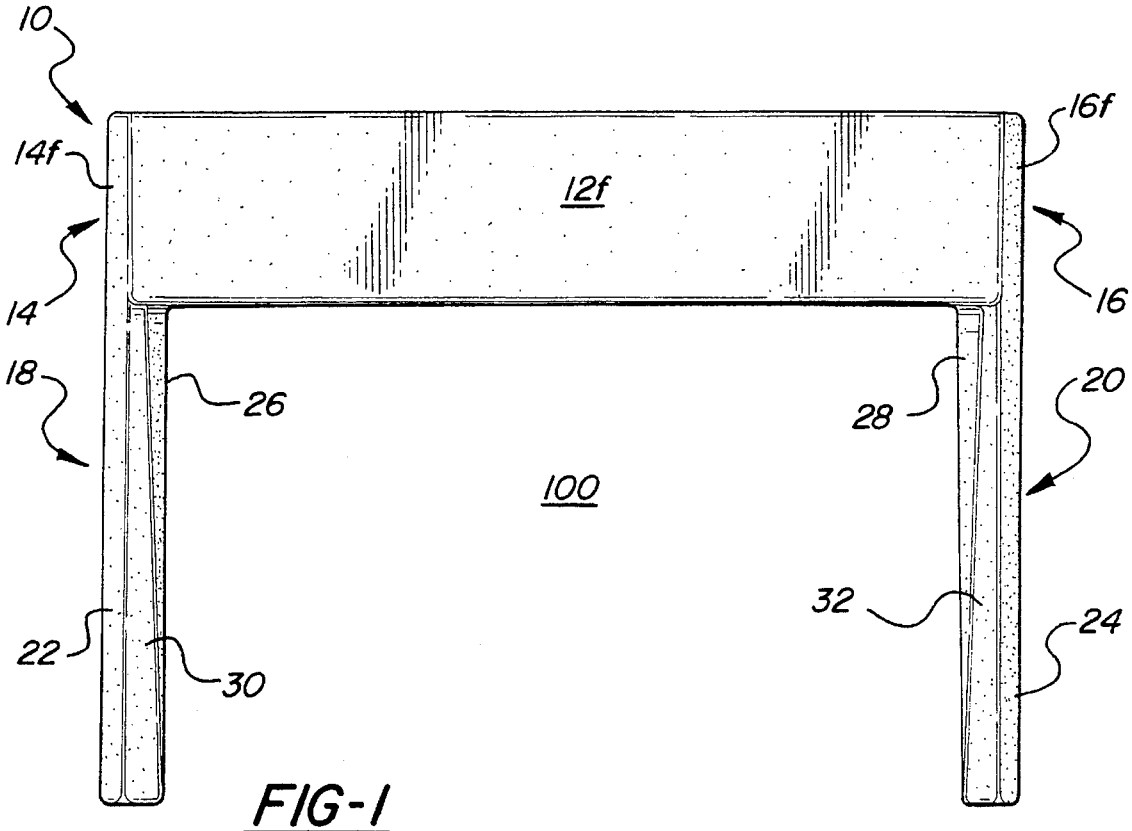
FIGS. 1–5 show shelf 10 of this invention.

FIG. 1 shows shelf 10 as it appears when looking toward glass pane 100 (mounted in shower door frame, not shown) against which the back of shelf 10 rests. Shelf 10 has front 12, the front surface of which is shown in FIG. 1 as **12*f*. Shelf 10 has left and right rectilinear shaped sides 14,16, the surfaces 14*f*,16*f* of which sides 14,16 being shown in FIG. 1 as outwardly flaring (somewhat exaggerated in FIG. 1) away from surface 12*f***.

FIG. 1 shows left and right legs 18,20 of shelf 10. Legs 18,20 respectively have left and right outer trapezoidal shaped side surfaces 22,24 respectively contiguous bottoms **14*b*,16*b* of sides 14,16. Legs 18,20 also have left and right inner trapezoidal shaped sides 26, 28. Left and right leg fronts 30,32 respectively extend between left inner and outer sides 22,26 and between right inner and outer sides 24, 28**.

Figure 2:
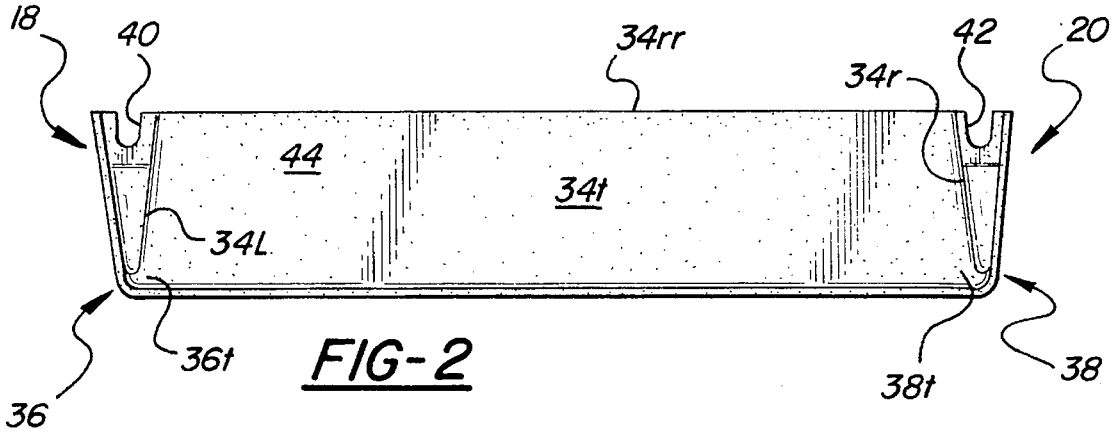
Figure 3:
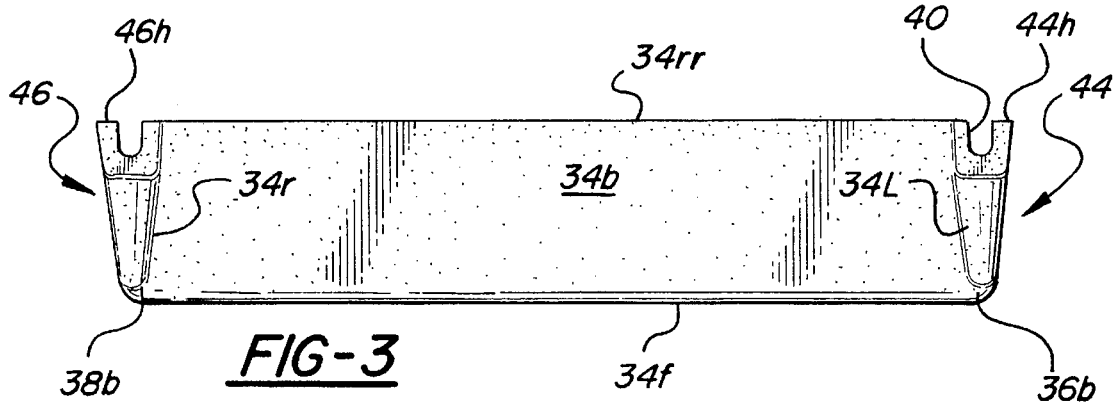

FIGS. 2 and 3, respectively, show top and underside surfaces **34*t*,34*b* of tray 34. Tray 34, unobstructed between left and right tray edges 34*l*,34*r*, has front and rear tray edges 34*f*,34*rr*. FIGS. 2 and 3 also respectively depict top surface 36*t*, 38*t* of left and right connectors 36,38 and bottom surfaces 36*b*,38*b* thereof. Connectors 36,38 respectively connect to left and right sides 14,16, tray 34 and front 12. FIGS. 2, 3 also show left and right drains 40,42 which permit shelf 10 to be drained respectively through legs 18,20 out of respective holes 44*h*,46*h* in right and left bottoms 44,46** thereof.

Figure 4:
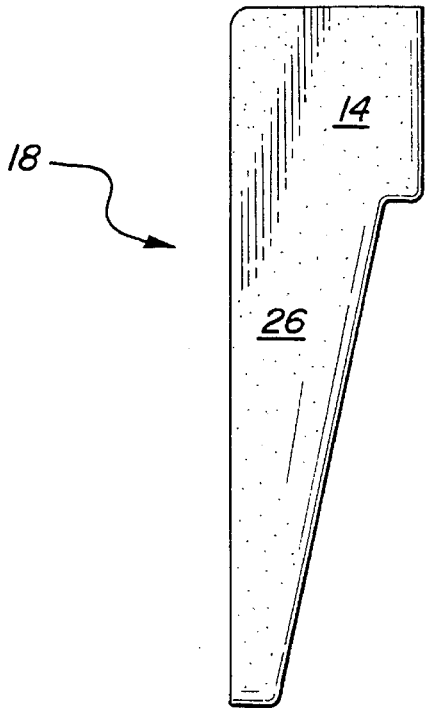

FIG. 4, a side plan view of shelf 10 from the left, shows left leg 18 which has a wedge shape. (Right leg 20 (not shown in FIG. 4), were it to be shown in plan view from the right, would be seen as the mirror image of left leg 18.) Left leg 18 has left rectilinear shaped side 14 and contiguous left outer trapezoidal shaped side 26 of left leg 18.

Figure 5:
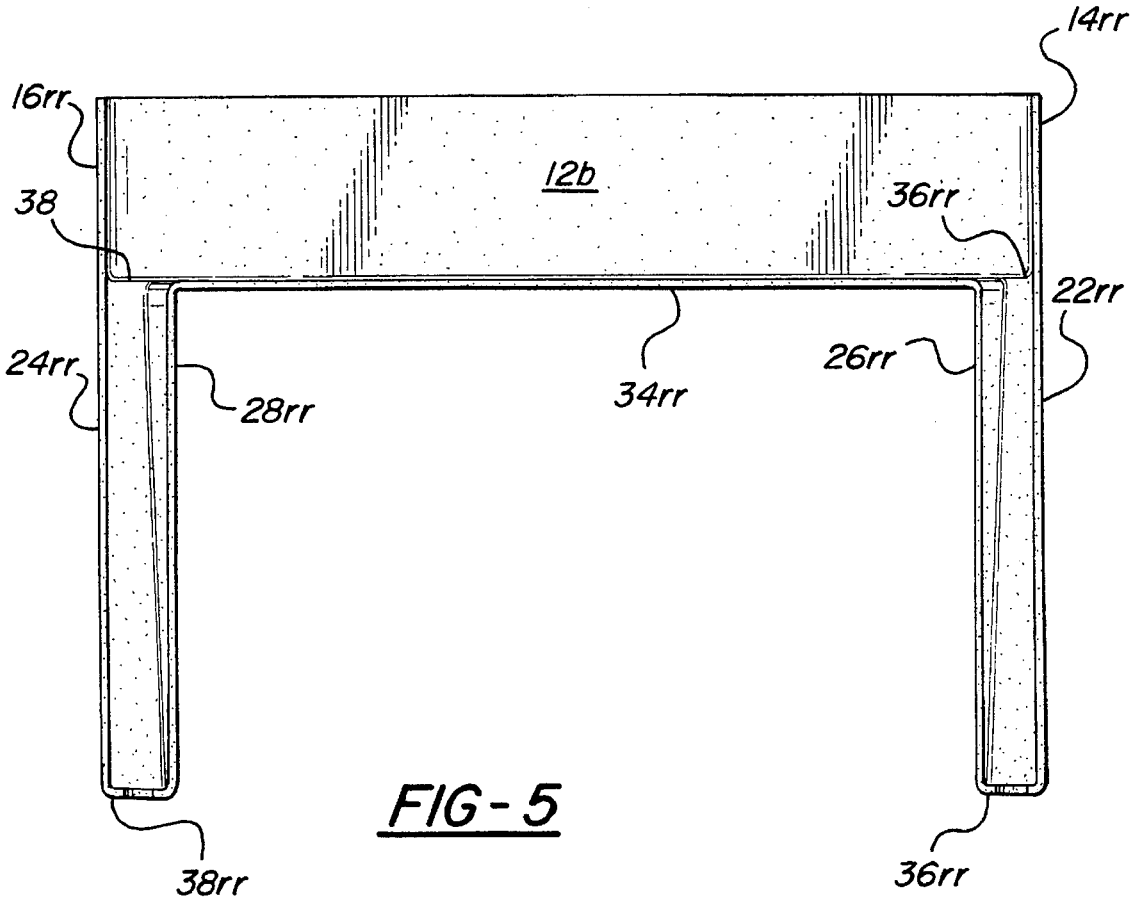

FIG. 5, a plan view from the back of shelf 10, shows backside **12*b* of front 12. FIG. 5 shows rear edges of a number of previously identified elements. FIG. 5 shows rear edge 34*rr* of tray 34, rear edges 14*rr*,16*rr* of left and right sides 14,16, rear edges 26*rr*,28*rr* of left and right inner trapezoidal shaped sides 26,28 and rear edges 22*rr*,24*rr* of left and right trapezoidal shaped outer sides 22,24. These rear edges each mount flush against the pane carried in a shower door (not shown). Thin walls of shelf 10** permit its parts to flex when fitting it against the pane of a shower door.

Shelves of this invention advantageously are made of moldable material such as plastic using conventional molding processes, e.g., injection molding, vacuum forming, blow molding and the like. Tapered leg design simplifies manufacture of the shelves and permits them to be stackable.

Having described this invention in terms of a specific embodiment thereof, it will be understood that, using principles disclosed in the specific embodiment, other embodiments of various character may be made without departing from the true scope of this invention which is set forth in the hereinafter appended claims.

What is claimed is:

1. A shelf mounting between shower door and handle or bar mounted on said door, said shelf being an integrally molded body comprising:

a compartment having (a) a tray with a front edge, a rear edge, a first edge and a second edge, said front edge being between said first edge and said second edge, (b) a front extending above said tray along said front edge and having a first end and a second end and (c) a first side integral said first end and a second side integral said second end, said first side spaced from said tray along said first edge and said second side spaced from said tray along said second edge;

a first, wedge shaped, hollow leg and a second, wedge shaped hollow leg, said first hollow leg having a first leg inner side and a first leg outer side and said second hollow leg having a second leg inner side and a second leg outer side, said first leg outer side depending beneath said first side and said second leg outer side depending beneath said second side, said first leg inner side depending beneath said tray under said first edge, and said second leg inner side depending beneath said tray under said second edge.

2. The shelf in accordance with claim 1, wherein said front is integral said front edge along said front edge.

3. The shelf in accordance with claim 2, wherein a distance between said first and second edges is greater than distance between said front and rear edges.

4. The shelf in accordance with claim 3, wherein said first and second leg inner sides respectively depend perpendicular from said tray.

5. A shelf mounting between a shower door and a bar or handle mounted to the door, said shelf being an integrally molded body comprising:

a compartment atop first and second legs that are hollow, said compartment having (a) a tray having front, rear, first and second edges, said front edge being between said first and second edges, (b) a front extending above said tray along said front edge and having first and second ends and (c) first and second sides respectively integral said first and second ends and spaced from said tray along said first and second edges;

said first and second hollow legs respectively having inner and outer sides that are trapezoidal shaped, said inner side of said first leg depending from said tray beneath said first edge and said inner side of said second leg depending from said tray beneath said second edge.

6. The shelf in accordance with claim 5, wherein said outer side of said first leg depends from said first side.

7. The shelf in accordance with claim 6, which comprises first and second connectors, said first and second connectors respectively extending from said tray to said first side and from said tray to said second side.

8. The shelf in accordance with claim 7, wherein said second connector extends along said second edge more than half the distance between said front and rear edges.

9. The shelf in accordance with claim 7, wherein said second connector extends along said second edge less than half the distance between said front and rear edges.

10. The shelf in accordance with claim 5, wherein said front and said front edge are integral along said front edge.

11. The shelf in accordance with claim 5, wherein a bottom surface extends across between inner and outer sides of said first leg a distance below said tray.

12. The shelf in accordance with claim 11, wherein said bottom surface has a hole.

13. The shelf in accordance with claim 5, wherein said front and said tray are perpendicular.

14. A shelf mounting between shower door and handle or bar mounted to said door, said shelf being an integrally molded body comprising:

an open, thin walled compartment atop first and second hollow legs, said compartment having (a) a tray having a first edge, a second edge, a front edge and a rear edge wherein said front edge extends between said first edge and said second edge, (b) a front extending above said tray along said front edge and having first and second ends and (c) first and second sides respectively integral said first and second ends and spaced from said first and second edges;

said first and second hollow legs being wedged shaped and respectively having inner and outer sides that are thin wall, said inner sides of said first and second hollow legs depending beneath said tray and said outer sides of said first and second hollow legs depending respectively from said first and second sides.

15. The shelf in accordance with claim 14, wherein said inner sides are parallel with one another.

16. The shelf in accordance with claim 14, wherein first and second connections respectively are located at first and second locations, said connections respectively connecting at said first location said tray, said first end and said first side and said right connection connecting at said second location said second end, said second side and said tray.

17. The shelf in accordance with claim 14, wherein said front and said front edge are integral along said front edge.

* * * * *